US010405608B2

(12) United States Patent
Dyer et al.

(10) Patent No.: US 10,405,608 B2
(45) Date of Patent: Sep. 10, 2019

(54) LACING SYSTEM WITH LOOPS FOR TIGHTENING AND LOOSENING

(71) Applicant: NIKE, Inc., Beaverton, OR (US)

(72) Inventors: Caleb W. Dyer, Beaverton, OR (US); Austin Orand, Beaverton, OR (US); Andrea M. Vinet, Portland, OR (US); Samantha Young, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 14 days.

(21) Appl. No.: 15/791,930

(22) Filed: Oct. 24, 2017

(65) Prior Publication Data

US 2018/0110295 A1 Apr. 26, 2018

Related U.S. Application Data

(60) Provisional application No. 62/413,210, filed on Oct. 26, 2016.

(51) Int. Cl.

| | |
|---|---|
| ***A43C 1/04*** | (2006.01) |
| ***A43C 7/06*** | (2006.01) |
| ***A43B 23/02*** | (2006.01) |
| ***A43C 11/16*** | (2006.01) |
| ***A43C 1/06*** | (2006.01) |
| ***A43C 11/00*** | (2006.01) |

(52) U.S. Cl.

CPC ..... *A43C 1/04* (2013.01); *A43B 23/0245* (2013.01); *A43C 1/06* (2013.01); *A43C 7/06* (2013.01); *A43C 11/008* (2013.01); *A43C 11/16* (2013.01)

(58) Field of Classification Search

CPC ..... A43C 7/06; A43C 11/008; A43C 11/16

USPC ..... 36/50.1, 50.5

See application file for complete search history.

(56) References Cited

U.S. PATENT DOCUMENTS 2,602,207 A 7/1952 Kellems
3,722,112 A * 3/1973 Morgan ..... A43B 5/0435 36/118.8

(Continued)

FOREIGN PATENT DOCUMENTS

CH 624001 A5 7/1981

OTHER PUBLICATIONS

European Patent Office (ISA), International Search Report and Written Opinion for International Application No. PCT/US2017/058306, dated Dec. 15, 2017.

*Primary Examiner* — Ted Kavanaugh
(74) *Attorney, Agent, or Firm* — Honigman LLP; Matthew H. Szalach; Jonathan P. O'Brien

(57) ABSTRACT

An article of footwear includes an upper and a tensioning mechanism operable to move the upper between a tightened state and a loosened state and including a tensioning cable having a first end disposed on one of a lateral side and a medial side of the upper. The tensioning cable is movable in a tightening direction to move the tightening mechanism into a tightened state and movable in a loosening direction to move the tightening mechanism into a loosened state. The article of footwear also includes a locking device disposed on the one of the lateral side and the medial side of the upper. The locking device is operable between a locked state restricting movement of the tensioning cable in the loosening direction and an unlocked state permitting movement of the tensioning cable in both the loosening direction and the tightening direction.

19 Claims, 7 Drawing Sheets

(56) References Cited

U.S. PATENT DOCUMENTS

| | | | | | |
|---|---|---|---|---|---|
| 5,471,769 | A * | 12/1995 | Sink | A43B 11/00 | 24/712.1 |
| 5,537,763 | A * | 7/1996 | Donnadieu | A43C 1/00 | 36/50.1 |
| 5,839,210 | A * | 11/1998 | Bernier | A43B 1/0072 | 36/50.1 |
| 7,818,899 | B2 | 10/2010 | Dinndorf et al. | | |
| 7,856,740 | B2 * | 12/2010 | De Bast | A43B 5/14 | 24/593.11 |
| 2003/0177661 | A1 * | 9/2003 | Tsai | A43C 7/00 | 36/50.1 |
| 2005/0126043 | A1 * | 6/2005 | Reagan | A43B 3/0031 | 36/50.5 |
| 2005/0210706 | A1 | 9/2005 | Johnson | | |
| 2006/0196083 | A1 * | 9/2006 | Martin | A43B 5/0401 | 36/50.5 |
| 2007/0186447 | A1 | 8/2007 | Ramos | | |
| 2007/0240334 | A1 | 10/2007 | Johnson | | |
| 2008/0301919 | A1 * | 12/2008 | Ussher | A43B 3/0005 | 24/712.7 |
| 2010/0175278 | A1 * | 7/2010 | Seliger | A43B 5/0401 | 36/117.1 |
| 2010/0319216 | A1 | 12/2010 | Grenzke et al. | | |
| 2011/0030244 | A1 * | 2/2011 | Motawi | A43B 3/0031 | 36/117.1 |
| 2013/0255045 | A1 * | 10/2013 | Gonzalez | A43C 9/00 | 24/715.3 |

* cited by examiner

LACING SYSTEM WITH LOOPS FOR TIGHTENING AND LOOSENING

CROSS REFERENCE TO RELATED APPLICATION

This application claims priority to U.S. Provisional Application Ser. No. 62/413,210, filed Oct. 26, 2016, which is hereby incorporated by reference in its entirety.

FIELD

The present disclosure relates generally to articles of footwear having a lacing system with a tensioner for moving footwear between a tightened state and a loosened state.

BACKGROUND

This section provides background information related to the present disclosure which is not necessarily prior art.

Articles of footwear conventionally include an upper and a sole structure. The upper may be formed from any suitable material(s) to receive, secure and support a foot on the sole structure. A bottom portion of the upper, proximate to a bottom surface of the foot, attaches to the sole structure. Sole structures generally include a layered arrangement extending between an outsole providing abrasion-resistance and traction with a ground surface and a midsole disposed between the outsole and the upper for providing cushioning for the foot.

The upper may cooperate with laces, straps, or other fasteners to adjust the fit of the upper around the foot. For instance, laces may be tightened to close the upper around the foot and tied once a desired fit of the upper around the foot is attained. Care is required to ensure that the upper is not too loose or too tight around the foot each time the laces are tied. Moreover, the laces may loosen or become untied during wear of the footwear. While fasteners such as hook and loop fasteners are easier and quicker to operate than traditional laces, these fasteners have a propensity to wear out over time and require more attention to attain a desired tension when securing the upper to the foot.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
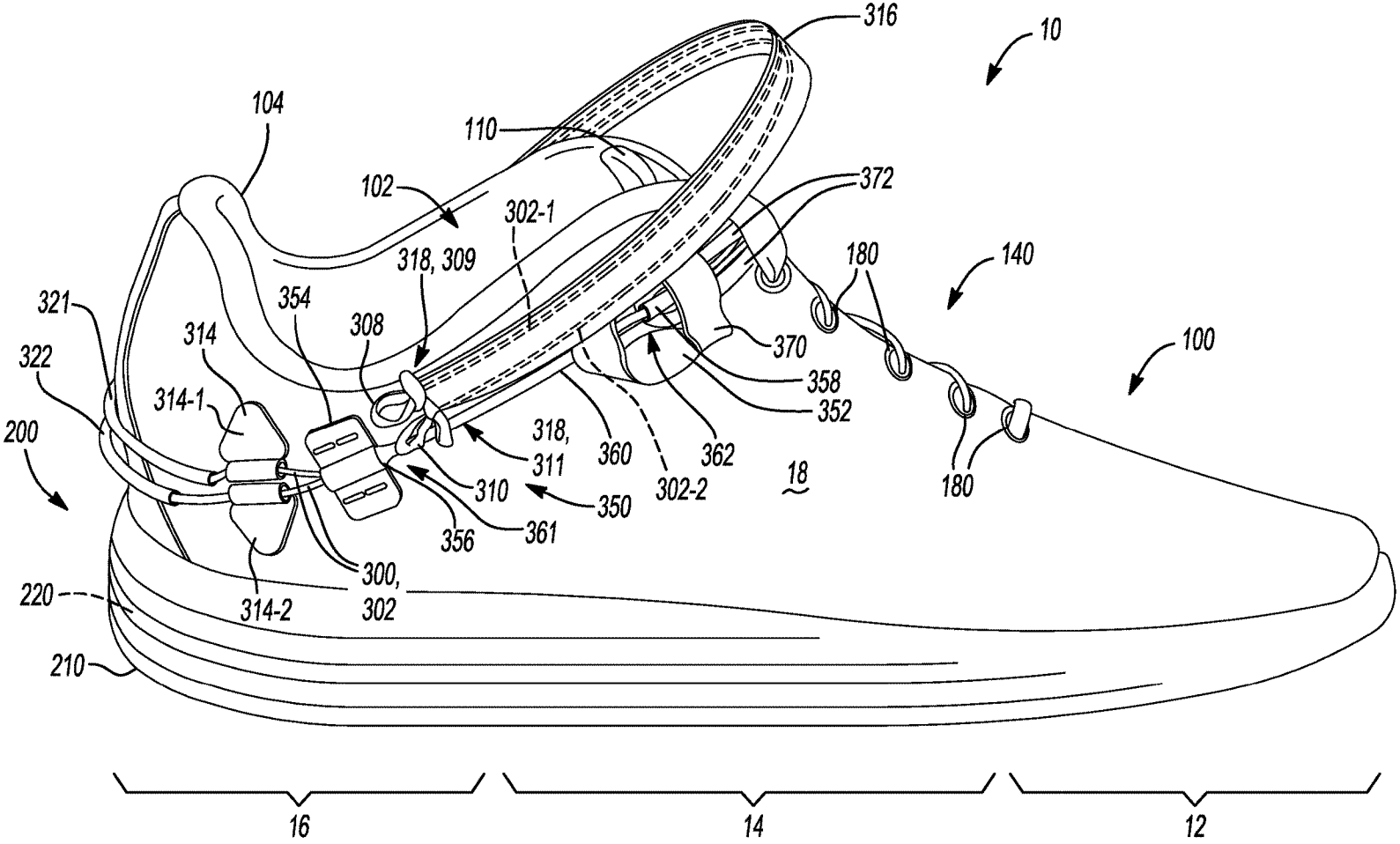
FIG. 1 is a top perspective view of an article of footwear showing a tensioning cable extending through a locking device disposed on a lateral side of an upper portion of the article of footwear in accordance with principles of the present disclosure.
Figure 2:
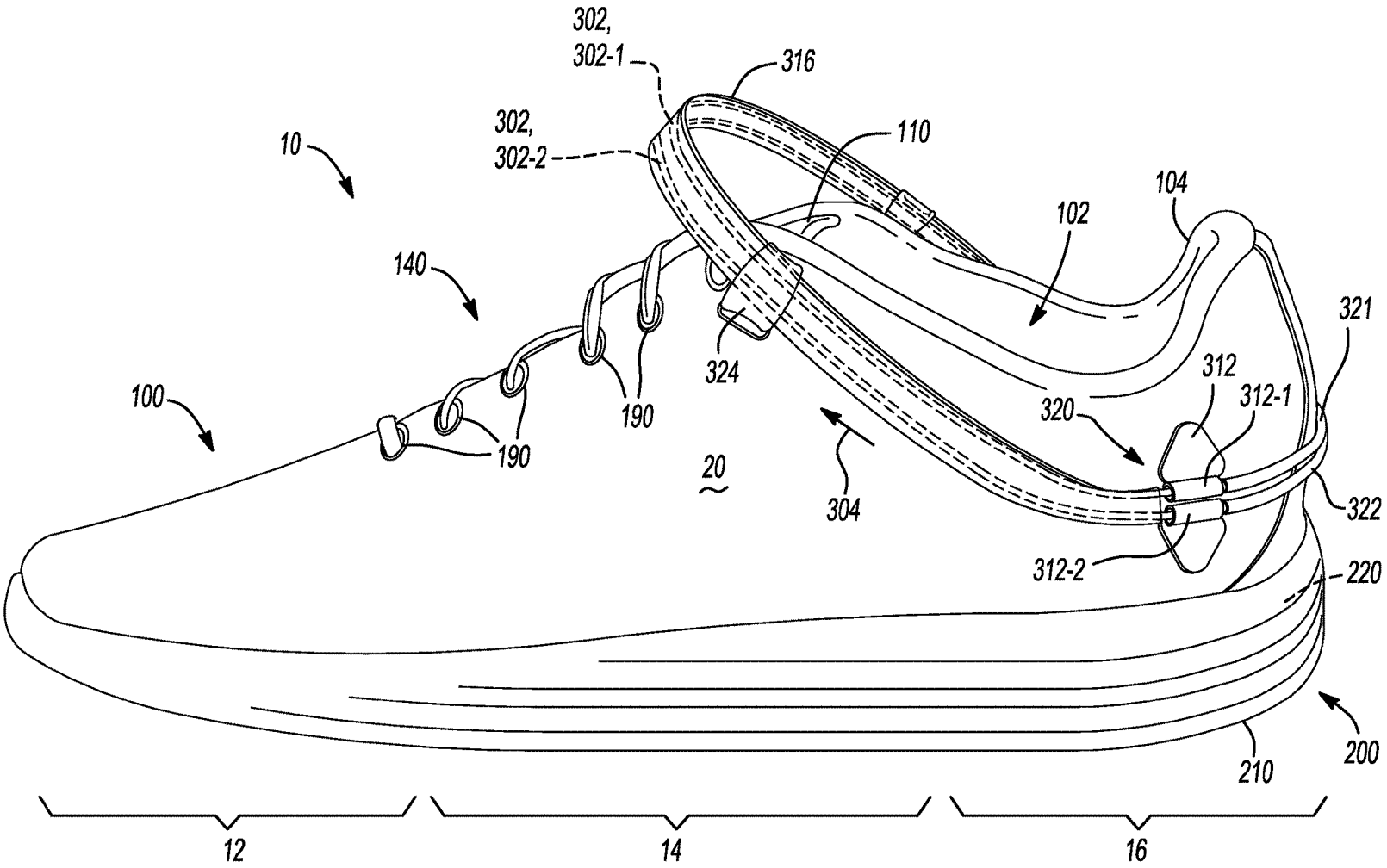
FIG. 2 is a top perspective view of the article of footwear of FIG. 1 showing the tensioning cable extending over a tongue portion and along a medial side of the upper portion.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

At least a portion of the upper of the article of footwear, and in some embodiments substantially the entirety of the upper, may be formed of a knitted component. The knitted component may additionally or alternatively form another element of the article of footwear such as the midsole, for example. The knitted component may have a first side forming an inner surface of the upper (e.g., facing the void of the article of footwear) and a second side forming an outer surface of the upper (e.g. facing generally away from the first side). An upper including the knitted component may substantially surround the void so as to substantially encompass the foot of a person when the article of footwear is in use. The first side and the second side of the knitted component may exhibit different characteristics (e.g., the first side may provide abrasion resistance and comfort while the second side may be relatively rigid and provide water resistance, among other advantageous characteristics mentioned below). The knitted component may be formed as an integral one-piece element during a knitting process, such as a weft knitting process (e.g., with a flat knitting machine or circular knitting machine), a warp knitting process, or any other suitable knitting process. That is, the knitting process may substantially form the knit structure of the knitted component without the need for significant post-knitting processes or steps. Alternatively, two or more portions of the knitted component may be formed separately as integral one-piece elements and then the respective elements attached. In some embodiments, the knitted component may be shaped after the knitting process to form and retain the desired shape of the upper (for example, by using a foot-shaped last). The shaping process may include attaching the knitted component to another object (e.g., a strobel) and/or attaching one portion of the knitted component to another portion of the knitted component at a seam by sewing, by using an adhesive, by bonding or by another suitable attachment process.

Forming the upper with the knitted component may provide the upper with advantageous characteristics including, but not limited to, a particular degree of elasticity (for example, as expressed in terms of Young's modulus), breathability, bendability, strength, moisture absorption, weight, and abrasion resistance. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, or an elastic material such as spandex) or construction (e.g., multifilament or monofilament), by selecting yarns of a particular size (e.g., denier), or a combination thereof. The knitted component may also provide desirable aesthetic characteristics by incorporating yarns having different colors, textures or other visual properties arranged in a particular pattern. The yarns themselves and/or the knit structure formed by one or more of the yarns of the knitted component may be varied at different locations such that the knitted component has two or more portions with different properties (e.g., a portion forming the throat area of the upper may be relatively elastic while another portion may be relatively inelastic). In some embodiments, the knitted component may incorporate one or more materials with properties that change in response to a stimulus (e.g., temperature, moisture, electrical current, magnetic field, or light). For example, the knitted component may include yarns formed of a thermoplastic polymer material (e.g., polyurethanes, polyamides, polyolefins, and nylons) that transitions from a solid state to a softened or liquid state when subjected to certain temperatures at or above its melting point and then transitions back to the solid state when cooled. The thermoplastic polymer material may provide the ability to heat and then cool a portion of the knitted component to thereby form an area of bonded or continuous material that exhibits certain advantageous properties including a relatively high degree of rigidity, strength, and water resistance, for example.

In some embodiments, the knitted component may include one or more yarns or strands that are at least partially inlaid or otherwise inserted within the knit structure of the knitted component during or after the knitting process, herein referred to as "tensile strands." The tensile strands may be substantially inelastic so as to have a substantially fixed length. The tensile strands may extend through a plurality of courses of the knitted component or through a passage formed within the knitted component and may limit the stretch of the knitted component in at least one direction. For example, the tensile strands may extend from an area underfoot, and/or approximately from a biteline of the upper to a throat area of the upper to limit the stretch of the upper in the lateral direction. The tensile strands may form one or more lace apertures for receiving a lace and/or may extend around at least a portion of a lace aperture formed in the knit structure of the knitted component.

One aspect of the disclosure includes an article of footwear including an upper and a tensioning cable having a first end disposed on one of a lateral side and a medial side of the upper. The tensioning cable is movable in a tightening direction to move the upper into a tightened state and movable in a loosening direction to move the upper into a loosened state. The article of footwear also includes a locking device disposed on the one of the lateral side and the medial side of the upper. The locking device is operable between a locked state restricting movement of the tensioning cable in the loosening direction and an unlocked state permitting movement of the tensioning cable in both the loosening direction and the tightening direction.

This aspect includes one or more of the following optional features. In some examples, the article of footwear further includes a sheath extending from a first end disposed on the one of the lateral side and the medial side, around a tongue portion of the upper, and to a second end disposed on the other of the lateral side and the medial side of the upper. The sheath includes an inner diameter that is greater than an outer diameter of the tensioning cable and receives a portion of the tensioning cable therein. The sheath may be operable to accommodate bunching by the tensioning cable when the tensioning cable is moved in the tightening direction In some implementations, the tensioning cable extends from the first end, around a tongue portion of the upper, and to a first anchor disposed on the other of the lateral side and the medial side of the upper. Additionally, the tensioning cable may extend from the first anchor around a heel portion of the upper to a second anchor disposed on the one of the lateral side and the medial side of the upper. In some examples, a location of the second anchor is disposed further from an ankle opening of the upper than the first end of the tensioning cable. Moreover, the article of footwear may further include at least one routing conduit that includes an inner diameter that is greater than an outer diameter of the tensioning cable and receives a portion of the tensioning cable that extends around the heel portion of the upper between the first anchor and the second anchor.

In some configurations, the tensioning cable extends around the heel portion of the upper from the first anchor and through the locking device. The locking device may include a braided conduit receiving a portion of the tensioning cable therein and operable between an elongated position restricting movement of the tensioning cable in both the loosening direction and the tightening direction and a compressed position permitting movement of the tensioning cable in both the loosening direction and the tightening direction. The braided conduit may be biased in the elongated position by an elastic band. Additionally or alternatively, the tensioning cable may be moved in the tightening direction through the braided conduit when the tensioning cable is pulled away from the upper.

In some examples, the braided conduit is biased in the elongated position and transitions to an intermediate compressed position when the tensioning cable is pulled away from the upper, wherein the intermediate compressed position permits movement of the tensioning cable in the tightening direction and restricts movement of the tensioning cable in the loosening direction. The braided conduit may extend between a first end operatively connected to a first attachment mechanism fixedly attached to the one of the lateral side and the medial side of the upper and a second end operatively connected to a second attachment mechanism movable relative to the first attachment mechanism.

The article of footwear may further include a release operatively connected to the second attachment mechanism. The release is operable to move the second attachment mechanism toward the first attachment mechanism to move the braided conduit into the compressed position when a force of a predetermined magnitude is applied to the release. In some examples, the tensioning cable extends from the second attachment mechanism and routes through a series of lateral engagement features extending along a lateral edge of a throat opening of the upper, and a series of medial engagement features extending along a medial edge of the throat opening of the upper.

Another aspect of the present disclosure provides a method of manufacturing an article of footwear including an upper. The method includes providing a tensioning cable movable in a tightening direction to move the upper into a tightened state and movable in a loosening direction to move the upper into a loosed state. The tensioning cable is disposed on one of a lateral side and a medial side of the upper. The method further includes extending the tensioning cable through a locking device disposed on the one of the lateral side and the medial side of the upper, the locking device operable between a locked state restricting movement of the tensioning cable in the loosening direction and an unlocked state permitting movement of the tensioning cable in both the loosening direction and the tightening direction.

This aspect provides one or more of the following optional features. In some implementations, the method further includes extending the tensioning cable through a sheath extending from a first end disposed on the one of the lateral side and the medial side, around a tongue portion of the upper, and to a second end disposed on the other of the lateral side and the medial side of the upper. The sheath may be operable to accommodate bunching by the tensioning cable when the tensioning cable is moved in the tightening direction.

In some examples, extending the tensioning cable through the locking device includes extending the tensioning cable through a braided conduit operable between an elongated position restricting movement of the tensioning cable in both the loosening direction and the tightening direction and a compressed position permitting movement of the tensioning cable in both the loosening direction and the tightening direction. Additionally or alternatively, the method may further include extending the braided conduit between a first end operatively connected to a first attachment mechanism fixedly attached to the one of the lateral side and the medial side of the upper and a second end operatively connected to a second attachment mechanism movable relative to the first attachment mechanism.

Referring to FIGS. 1-5, in some implementations, an article of footwear 10 includes an upper 100, a sole structure 200 attached to the upper 100, and a tightening mechanism 300 operable to move the upper 100 between a tightened state (FIG. 3) and a loosened state (FIG. 5) when the tightening mechanism 300 moves between corresponding ones of a tightened state and a loosened state. The article of footwear 10 may be divided into one or more portions. The portions may include a forefoot portion 12, a mid-foot portion 14 and a heel portion 16. The forefoot portion 12 may correspond with toes and joints connecting metatarsal bones with phalanx bones of a foot. The mid-foot portion 14 may correspond with an arch area of the foot, and the heel portion 16 may correspond with rear portions of the foot, including a calcaneus bone. The footwear 10 may include lateral and medial sides 18, 20, respectively, corresponding with opposite sides of the footwear 10 and extending through the portions 12, 14, 16.

Figure 3:
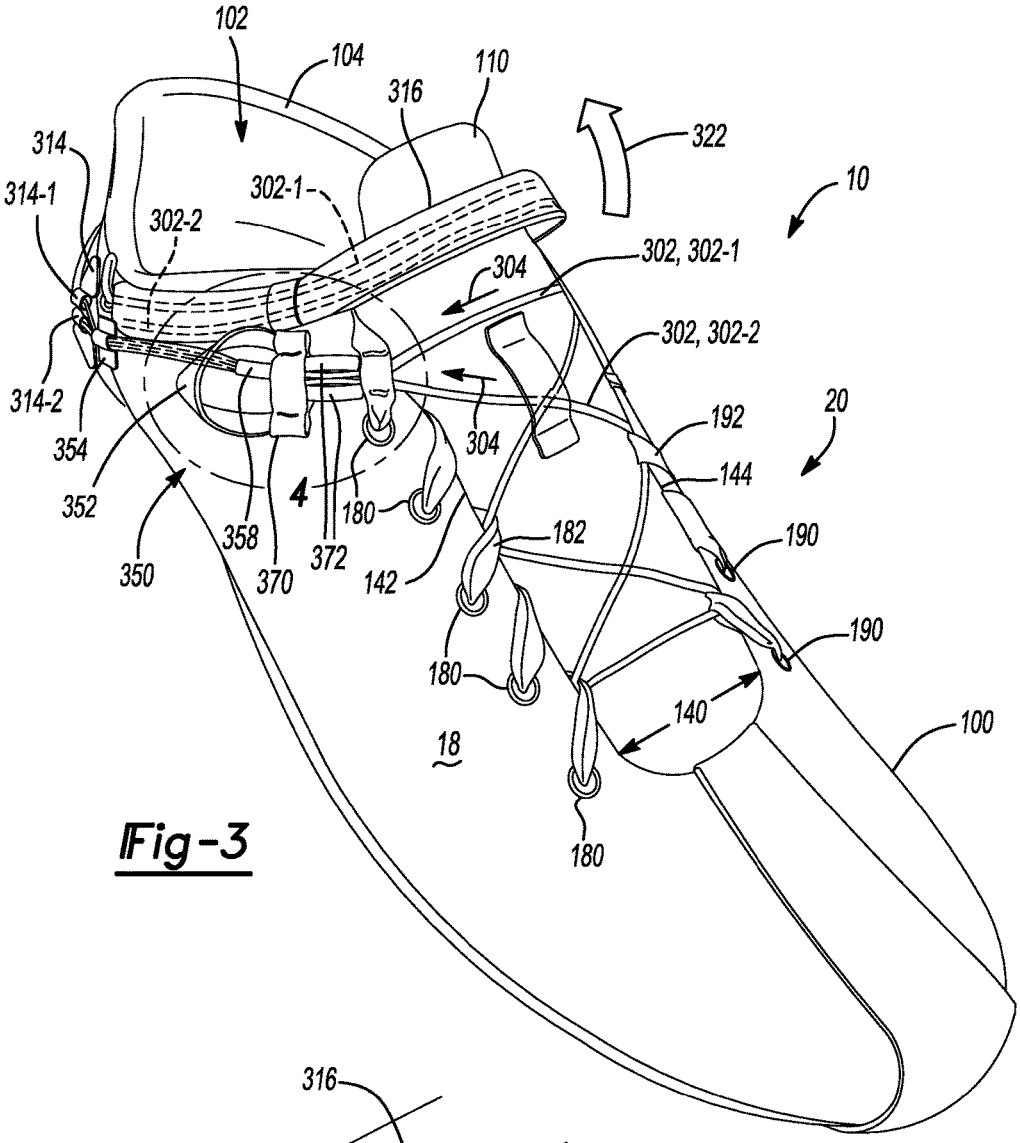
FIG. 3 is a top perspective view of the article of footwear of FIG. 1 showing the tensioning cable moving in a tightening direction when a pulling force is applied thereto.
Figure 5:
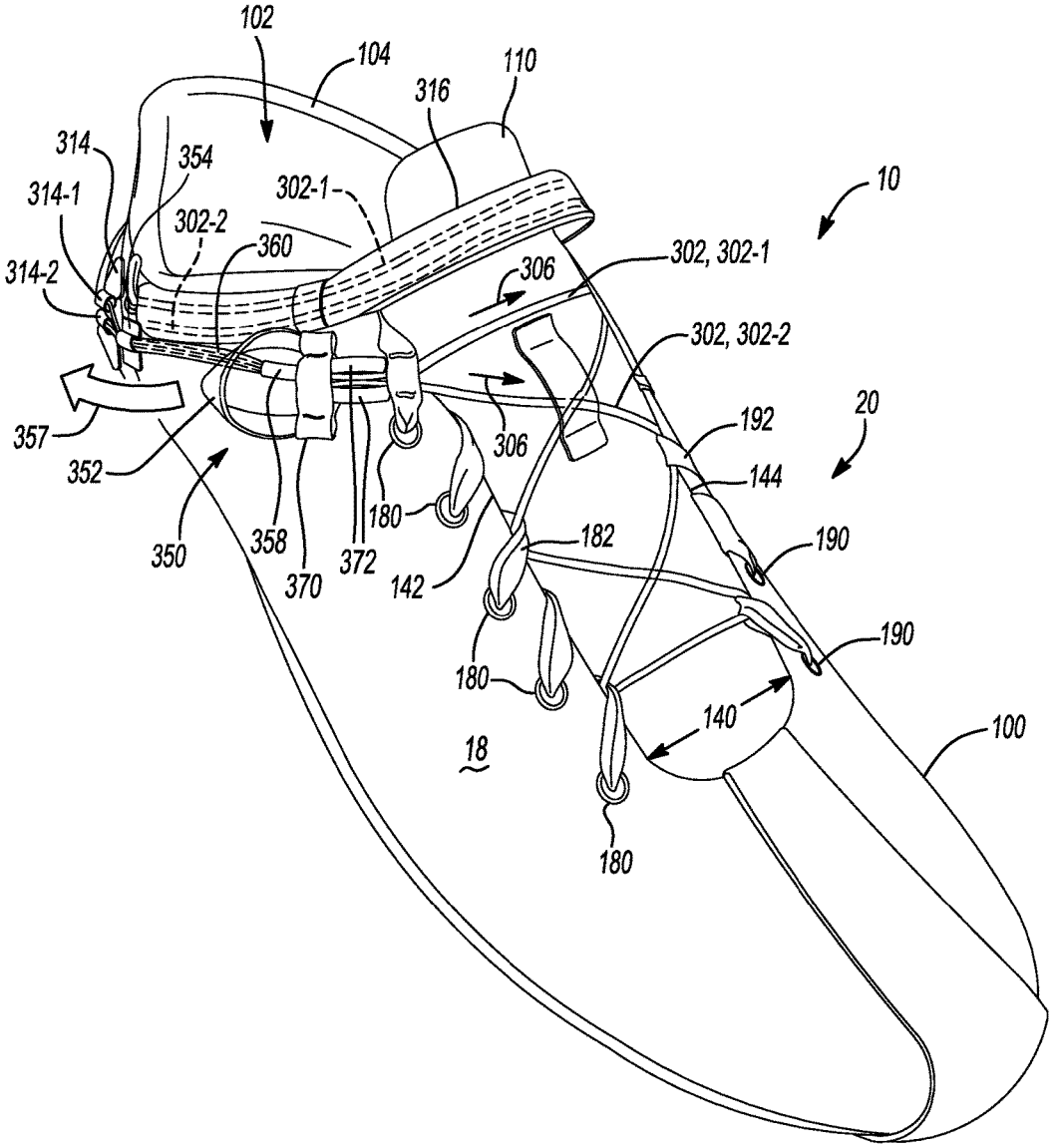
FIG. 5 is a top perspective view of the article of footwear of FIG. 1 showing the locking device transitioning into an unlocked state when a release force is applied to a release mechanism operatively connected to the locking device.

The upper 100 includes interior surfaces that define an interior void 102 configured to receive and secure a foot for support on the sole structure 200. An ankle opening 104 in the heel portion 16 may provide access to the interior void 102. For example, the ankle opening 104 may receive a foot to secure the foot within the void 102 and facilitate entry and removal of the foot from and to the interior void 102. A throat opening 140 corresponding to an instep of the foot, extends between a lateral edge 142 and a medial edge 144 of the upper 100 and from the ankle opening 104 to an area adjacent the forefoot portion 12. In some examples, the upper 100 includes a series of lateral engagement features 180 that extend along the lateral edge 142 of the throat opening 140 and a series of medial engagement features 190 that extend along the medial edge 144 of the throat opening 140. The engagement features 180, 190 may include apertures (eyelets) formed through the upper 100 that extend along corresponding ones of the lateral and medial edges 142 and 144. In other configurations, the engagement features 180, 190 may include a series of mesh loops attached to the upper 100 along corresponding ones of the lateral and medial edges 142 and 144. Additionally or alternatively, and as shown in the examples of FIGS. 3 and 5, a lateral lace 182 may extend through each lateral aperture (e.g., eyelet) along the lateral edge 142 to define a series of loops associated with the lateral engagement features 180, while a medial lace 192 may extend through each medial aperture (e.g., eyelet) along the medial edge 144 to define a series of loops associated with the medial engagement features 190.

In some examples, the tightening mechanism 300 includes a tensioning cable 302 that extends along the upper 100 to adjust a fit of the interior void 102 around the foot and accommodate entry and removal therefrom. More specifically, the tensioning cable 302 may route through the engagement features 180, 190 to automatically move the upper 100 between the tightened state and the loosened state when the tightening mechanism 300 moves between the corresponding ones of the tightened state and the loosened state. For instance, movement by the tightening mechanism 300 in the tightened state cinches the upper 100 by drawing the lateral and medial edges 142 and 144 toward one another to close or constrict the throat opening 140 such that the inter void 102 closes around the foot. Here, the tensioning cable 302 is movable in a tightening direction 304 (FIG. 3) to move the tightening mechanism 300 into the tightened state. Conversely, movement by the tightening mechanism 300 in the loosened state relaxes the upper 100 to open the interior void 102 for removal of the foot therefrom. Here, the tensioning cable 302 is movable in a loosening direction 306 (FIG. 5) to move the tightening mechanism 300 into the loosened state.

The upper 100 may include a tongue portion 110 that extends along the throat opening 140 between the interior void 102 and the tensioning cable 302. The upper 100 may be formed from one or more materials that are stitched or adhesively bonded together to form the interior void 102. Suitable materials of the upper may include, but are not limited, textiles, foam, leather, and synthetic leather. The materials may be selected and located to impart properties of durability, air-permeability, wear-resistance, flexibility, and comfort.

In some implementations, the sole structure 200 includes an outsole 210 and a midsole 220 arranged in a layered configuration. For example, the outsole 210 engages with a ground surface during use footwear 10 and the midsole 220 is disposed between the upper 100 and the outsole 210. In some examples, the sole structure 200 may also incorporate additional layers such as an insole or sockliner that may reside within the interior void 102 of the upper 100 to receive a plantar surface of the foot to enhance the comfort of the footwear 10. The outsole 210 may attach to the upper 100 and generally provide abrasion-resistance and traction with the ground surface. Accordingly, the outsole 210 may be formed form one or more materials that impart durability and wear-resistance, as well as enhance traction with the ground surface. For example, rubber may form at least a portion of the outsole 210. The midsole 220 may secure to the upper 100 using stitching or adhesives and may define a footbed surface that may be contoured to conform to a profile of the bottom surface (e.g., plantar) of the foot). One or more polymer foam materials may form the midsole 220 and/or portions of the outsole to provide resilient compressibility under an applied load to attenuate ground-reaction forces. In some examples, the midsole 220 is integrally formed with the outsole 210 and extends through the portions 12, 14, 16 of the footwear 10.

In some implementations, the tensioning cable 302 extends between a first end 308 attached to the upper 100 at an attachment location 309 and a second end 310 attached to the upper 100 at an attachment location 311. The attachment locations 309, 311 associated with the first and second ends 308, 310, respectively, of the tensioning cable 302 may be disposed substantially adjacent to one another in an area along the lateral side 18 of the upper 100 within the heel portion 16 of the footwear 10. The tensioning cable 302 may define a first segment 302-1 extending from the first end 308 at the attachment location 309 and a second segment 302-2 extending substantially parallel to the first segment 302-1 from the second end 310 at the attachment location 311. In other configurations, the attachment locations 309, 311 may be disposed along the medial side 20 of the upper 100 and/or within the mid-foot or forefoot portions 14, 12, respectively, of the footwear 10.

From their corresponding attachment locations 309, 311 at the lateral side 18 of the upper 100, the segments 302-1, 302-1 of the tensioning cable 302 may extend substantially parallel to one another around the tongue portion 110 proximate to where the ankle opening 104 and the throat opening 140 meet (i.e., proximate to above the instep of the wearer's foot) to a medial anchor feature 312 (FIG. 2) disposed in an area along the medial side 20 of the upper 100 within the heel portion 16 of the footwear 10. The medial anchor feature 312 may fixedly secure to the upper 100 via stitching or adhesives and may define a pair of passages 312-1, 312-2 each operative for one of the corresponding segments 302-1, 302-2 to extend therethrough. The segments 302-1, 302-2 of the tensioning cable 302 may then extend around the heel end of the footwear 10 from the medial anchor feature 312 to a lateral anchor feature 314 (FIG. 1) disposed in an area along the lateral side 18 of the upper 100 within the heel portion 16. As with the medial anchor feature 312 disposed at the medial side 20, the lateral anchor feature 314 may fixedly secure to the upper 100 via stitching or adhesives and may define a pair of passages 314-1, 314-2 each operative for one of the corresponding segments 302-1, 302-2 to extend therethrough.

As shown in FIG. 1, the attachment locations 309, 311 of the tensioning cable 302 may be disposed closer to the mid-foot portion 14 and further from the outsole 210 relative to the location of the lateral anchor feature 314 disposed on the upper 100. Thereafter, the segments 302-1, 302-1 of the tensioning cable 302 extend in parallel through a locking device 350 disposed along the lateral side 18 of the upper 100, and exit the locking device 350 at an area proximate to where the lateral edge 142 of the throat opening 140 and the ankle opening 104 meet. Referring to FIGS. 3 and 5, the first segment 302-1 and the second segment 302-2 of the tensioning cable 302 separate from one another after exiting the locking device 350 and route through the series of lateral and medial engagement features 180, 190 extending along the corresponding lateral and medial edges 142, 144 of the throat opening 140. In some configurations, the segments 302-1 and 302-2 route through the engagement features 180, 190 in corresponding lacing patterns that zigzag across the throat opening 140. For instance, the lace segments 302-1 and 302-2 may zigzag across the throat opening 140 by extending through the series of lateral loops defined by the routing of the lateral lace 182 through the lateral apertures 180 and the series of medial loops defined by the routing of the medial lace 192 through the medial apertures 190. Here, the series of loops defined by the lateral and medial laces 182, 192 along the corresponding lateral and medial edges 142, 144 may disperse tension applied by the tensioning cable 302 against the upper 100.

The locking device 350 is operable between a locked state restricting movement of the tensioning cable 302 in the loosening direction 306 and an unlocked state permitting movement of the tensioning cable 302 in both the loosening direction 306 and the tightening direction 304. In some configurations, the locking device 350 is biased into the locked state. In these configurations, the locking device 350 may include a release mechanism 352 operable to transition the locking device from the locked state to the unlocked state. For example, a release force 357 (FIG. 5) can be applied to the release mechanism 352 to transition the locking device 350 from the locked state to the unlocked state.

In some implementations, the segments 302-1 and 302-2 of the tensioning cable 302 include corresponding lacing patterns selected so that a total closure distance between the lateral edge 142 and the medial edge 144 of the throat opening 140 according to the corresponding lacing pattern for the first lace segment 302-1 is approximately equal to a total closure distance between the lateral edge 142 and the medial edge 144 of the throat opening 140 according to the corresponding lacing pattern for the second lace segment 302-2. Moreover, when the tensioning cable 302 moves in the tightening direction 304, a take up distance of the first lace segment 302-1 is approximately equal to a take up distance of the second lace segment 302-2. Thus, the take up distance of the first lace segment 302-1 is approximately equal to the total closure distance between the lateral edge 142 and the medial edge 144 of the throat opening 140 according to the corresponding lacing pattern for the first lace segment 302-1, while the take up distance of the second lace segment 302-2 is approximately equal to the total closure distance between the lateral edge 142 and the medial edge 144 of the throat opening 140 according to the corresponding lacing pattern for the second lace segment 302-2.

The tensioning cable 302 may be highly lubricious and/or be formed from one or more fibers having a low modulus of elasticity and a high tensile strength. For instance, the fibers may include high modulus polyethylene fibers having a high strength to weight ratio and very low elasticity. Additionally or alternatively, cable 302 may be formed from a molded monofilament polymer and/or woven steel with or without other lubrication coating. In some examples, the cable 302 includes multiple strands of material woven together.

In some implementations, a sheath 316 receives the portions of the lace segments 302-1, 302-2 that extend around the tongue portion 110 between the corresponding attachment locations 309, 311 disposed at the lateral side 18 of the upper 100*f* and the medial anchor feature 312 disposed at the medial side 20 of the upper 100*f*. The sheath 316 may include a fabric material that imparts elastic properties. The sheath 316 may extend between a first end 318 (FIG. 1) attached to the lateral side 18 of the upper 100 and a second end 320 (FIG. 2) attached to the medial side 20 of the upper 100. The first end 318 of the sheath 316 may attach to the upper 100 at a location proximate to the attachment locations 309, 311 for the ends 308, 310 of the tensioning cable 302, and the second end 320 of the sheath 316 may attach to the upper 100 at a location proximate to where the medial anchor feature 312 attaches to the upper 100. In some configurations, the sheath 316 defines a pair of channels that extend substantially parallel to one another between the first and second ends 318, 320. In these configurations, each channel is configured to receive a corresponding length of one of the lace segments 302-1, 302-2 therein. Thus, each channel may define an internal diameter that is greater than an outer diameter of the tensioning cable 302. In some examples, the first end 318 of the sheath 316 attaches to the lateral side 18 of the upper 100*f* and the first and second ends 308, 310 of the tensioning cable 302 are exposed from the sheath 316 and knotted to fix the ends 308, 310 at the attachment locations 309, 311. Here, the knotted ends 318, 310 may serve as anchor points that prevent the ends 318, 310 for slipping into the channels of the sheath 316. In other configurations, the sheath 316 may define a single channel configured to receive both of the lace segments 302-1, 302-2.

In some examples, the sheath 316 enclosing the lace segments 302-1, 302-2 extends around the tongue portion 110 and through a medial locating loop 324 (FIG. 2) attached to the upper 100 at a location proximate to where the medial edge 144 of the throat opening 140 and the ankle opening 104 meet. The medial locating loop 324 may include a piece of fabric having ends secured to the upper 100 to define a loop therebetween with a width greater than the width of the sheath 316. The locating loop 324 may enable the portion of the sheath 316 that extends around the tongue portion 110 to define a loop exposed from the upper 100 and accessible for a user to grip. Here, the portion of the sheath 316 extending over the tongue portion 110 may correspond to a tightening grip that allows a wearer of the footwear 10 to apply a pull force 322 (FIG. 3) to pull the sheath 316 and tensioning cable 302 away from the upper 100 to move the cable 302 in the tightening direction 304, and thereby move the upper 100 into the tightened state by drawing the lateral and medial edges 142, 144 of the throat opening 140 together. Moreover, the medial locating loop 324 may allow the portion of the sheath 316 extending along the medial side 20 of the upper 100 from the medial locating loop 324 to the second end 320 of the sheath 316 to be substantially taut and flush against the upper 100.

In some implementations, a pair of routing tubes 321 and 322 extend around the heel of the upper 100 between the medial anchor feature 312 and the lateral anchor feature 314. The routing tubes 321, 322 are configured to receive corresponding portions of the lace segments 302-1, 302-2 of the tensioning cable 302 for routing around the heel of the footwear 10. For instance, upon exiting the channels at the second end 320 of the sheath 316, the first lace segment 302-1 may extend through the corresponding passage 312-1 of the medial anchor feature 312 and through the first routing tube 321 around the heel of the upper 100 before passing through the corresponding passage 314-1 of the lateral anchor feature 314. Similarly, the second lace segment 302-2 may extend through the corresponding passage 312-2 of the medial anchor feature 312 and through the second routing tube 322 around the heel of the upper 100 before passing through the corresponding passage 314-2 of the lateral anchor feature 314. The routing tubes 321 and 322 may extend substantially parallel to one another and be formed from a substantially rigid material having interior walls configured to facilitate movement of the lace segments 302-1, 302-2 when the tensioning cable 302 moves in the tightening direction 304 and in the loosening direction 306. In some examples, the tubes 321, 322 are lined or coated with a low friction material, such as a lubricous polymer (e.g., Teflon™), that facilitates slidability for unrestricted movement of the lace segments 302-1, 302-2 therethrough.

In some implementations, the locking device 350 is a one-way locking device 350 that permits movement of the tensioning cable 302 in the tightening direction 304 when the locking device 350 is in the locked state. This arrangement allows the tensioning cable 302 to move in the tightening direction 304 each time the pulling force 322 (FIG. 3) is applied to the looped portion of the sheath 316 that extends around the tongue portion 110, while restricting movement in either the tightening direction 304 or the loosening direction 306 when the pulling force 322 is released. In doing so, the interior void 102 can be incrementally tightened around the foot until a desired fit is achieved. In these implementations, the locking device 350 must transition from the locked state to the unlocked state to permit the tensioning cable 302 to move in the loosening direction 306 when the release force 357 (FIG. 5) is applied to the release mechanism 352. Here, the tensioning cable 302 does not automatically move in the loosening direction responsive to applying the release force 357 to the release mechanism 352, but rather, the wearer may wiggle the foot and pull the tongue portion 110 away from the foot while applying the release force 357 to facilitate movement of the tensioning cable 302 in the loosening direction 306, and thereby relax the upper 100 around the foot to open the throat opening 140 for removal of the foot therefrom.

In addition to routing the tensioning cable 302 around the tongue portion 110 from the attachment locations 309, 311 disposed at the lateral side 18 to the medial anchor feature 312 disposed at the medial side 20, the channels of the sheath 316 may also be operable to accommodate bunching by the tensioning cable 302 during movement by the tightening mechanism 300 in the tightened state. For instance, each channel of the sheath 316 receives a respective portion of the lace segments 302-1, 302-2 along the length of the tensioning cable 302, and is operable to accommodate bunching by the lace segments 302-1, 302-2 when the tensioning cable 302 moves in the tightening direction 304.

In scenarios when locking device 350 permits movement of the tensioning cable 302 in the tightening direction 304 while in the locked state, application of the pulling force 322 (FIG. 3) to the looped portion of the sheath 316 that extends around the tongue portion 110 causes the tensioning cable 302 to move in the tightening direction 304 such that the length of each of the lace segments 302-1, 302-1 increases between the medial anchor feature 312 and the free ends 308, 310 attached to the upper 100 at the corresponding attachment locations 309, 311. The elastic properties of the sheath 316 allow the sheath 316 to stretch while the tensioning cable 302 moves in the tightening direction 304 when the pulling force 322 is applied thereto. However, while the elastic properties of the sheath 316 cause the sheath 316 to revert back to its relaxed state when the pulling force 322 is released, the locking device 350 prevents the tensioning cable 302 from moving in the loosening direction 306 such that the upper 100 stays fixed in the tightened state. Without the use of the channels of the sheath 316 to accommodate bunching by the corresponding lace segments 302-1, 302-2, the increases in the length of the segments 301-1, 301-2 can result in the segments 301-1, 301-2 becoming tangled and/or being susceptible to catching on features such that the tensioning cable 302 may be inhibited from responsively and fluently moving in either of the directions 304, 306 when desired.

In some examples, the locking device 350 includes a braided member (e.g., braided rope or conduit) 360 extending between a first end 361 attached to a first attachment mechanism 354 and a second end 362 attached to a second attachment mechanism 358. The first attachment mechanism 354 may be fixedly attached to the upper 100 via stitching or adhesives and may define a passage 356 having an inlet operable to receive both lace segments 302-1, 302-2 exiting the corresponding passages 314-1, 314-2 of the lateral anchor feature 314, and an outlet fixedly attached to the first end 361 of the braided member 360 for routing the segments 302-1, 302-2 therethrough. The second attachment mechanism 358 is configured for movement relative to the upper 100 and defines a passage 359 having an inlet fixedly attached to the second end 362 of the braided member 360 for receiving the segments 302-1, 302-2, and an outlet operative to direct each of the segments 302-1, 302-2 toward the area proximate to where the lateral edge 142 of the throat opening 140 and the ankle opening 104 meet for routing through the engagement features 180, 190, as discussed above.

The movement by the second attachment mechanism 358 relative to the upper 100 allows the braided member 360 to move between an elongated position (i.e., when the second end 362 of the braided member 360 is biased away from the first end 361) and a compressed position (i.e., when the second end 362 of the braided member 360 is pulled toward the first end 361). For example, an interior wall 365 (FIGS. 7 and 9) of the braided member 360 constricts to grip and pinch the lace segments 302-1, 302 enclosed therein while the braided member 360 is in the elongated position and, thus, restricts movement by the lace segments 302-1, 302-1 in either direction 304, 306. Accordingly, the elongated position of the braided member 360 corresponds to the locked state of the locking device 350. Conversely, the diameter of the interior wall 365 of the braided member 360 enlarges when the braided member 360 moves to the compressed position such that the lace segments 302-1, 302-2 are permitted to move through the braided member 360 in both directions 304, 306. Accordingly, the compressed position of the braided member 360 corresponds to the unlocked state of the locking device 350.

Figure 4:
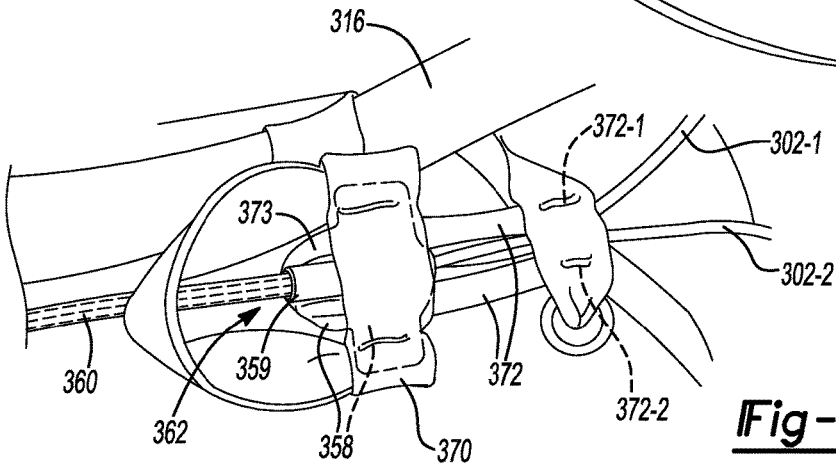
FIG. 4 is a detailed view within enclosed area 4 of FIG. 3 showing a braided member enclosing the tensioning cable and having an end attached to an attachment mechanism.

In some configurations, the second attachment mechanism 358 is operatively connected to a biasing member 372 that biases the second attachment mechanism 358 away from the first attachment mechanism 354. In these configurations, the biasing of the second attachment mechanism 358 is operative to bias the second end 362 of the braided member 360 attached thereto away from the first end 361 of the braided member 360 such that the braided member 360 is biased in the elongated position. The braided member 360 may be formed from multiple strands of monofilament polymer woven together in an interlocking pattern between the first and second ends 361 and 362 of the braided member 360. FIG. 4 provides a detailed view within area 4 of FIG. 3 showing the second attachment mechanism 358, the braided member 360, and the biasing member 372. In some examples, the biasing member 372 includes an elastic band 372 having first and second ends 372-1, 372-2 attached to the upper 100 proximate to the area where the lateral edge 142 of the throat opening 140 and the ankle opening 104 meet to define a loop portion 373 at the midpoint of the elastic band 372 that operatively connects to the second attachment mechanism 358. In some examples, the passage 359 of the second attachment mechanism 358 protrudes at the inlet side to retain the looped portion 373 of the elastic band 372 against the second attachment mechanism 358. Here, the elastic band 372 may apply constant tension to bias the second attachment mechanism 358 away from the first attachment mechanism 354 such that the braided member 360 is in the elongated position to constrict the interior wall 365 of the braided member 360 against the lace segments 302-1, 302-2. In some implementations, a fabric sleeve 370 attaches to the second attachment mechanism 358 and encloses a portion thereof for retaining the looped portion 373 of the elastic band 372 against the attachment mechanism 358. Additionally or alternatively, the fabric sleeve 370 may attach to both the second attachment mechanism 358 and the release mechanism 352 to operatively connect the release mechanism 352 to the second attachment mechanism 358.

Referring to FIG. 5, the release mechanism 352 is a fabric loop operatively connected to the second attachment mechanism 358 and accessible for a user to grip for applying the release force 357 to transition the locking device 350 to the unlocked state. The release force 357 may be applied to the release mechanism 352 in a direction opposite a biasing force 602 (FIG. 6) applied by the biasing member 372 to cause the second attachment mechanism 358 to translate toward the first attachment mechanism 354. Here, the movement by the second attachment mechanism 358 relative to the upper 100 is operative to simultaneously move the second end 362 of the braided member 360 toward the first end 361 so that the braided member 360 transitions to the compressed state. Accordingly, the tensioning cable 302 is permitted to move in either direction 304, 306 through the braided member 360 when the release force 357 is being applied to the release mechanism 352.

Moreover, and with reference to FIGS. 3 and 4, the tensioning cable 302 is permitted to move through the braided member 360 in the tightening direction 304 when the pulling force 322 is applied to the looped portion of the sheath 316 that extends around the tongue portion 110. Here, the magnitude of the pulling force 322 is sufficient for overcoming the biasing of the biasing member 372 to move the second attachment mechanism 358 toward the first attachment mechanism 354. Here, the movement of the attachment mechanism 358 may slightly move the braided member 360 to an intermediate compressed position sufficient for decreasing the pinching force applied by the interior wall 365 of the braided member 360 against the lace segments 302-1, 302-2 so that the lace segments 302-1, 302-2 may slip for relative movement through the braided member 360 in the tightening direction 304. When the pulling force 322 is released, the braided member 360 may bias back to the elongated position via the biasing of the biasing member 372 to restrict movement by the lace segments 302-1, 302-2.

Figure 6:
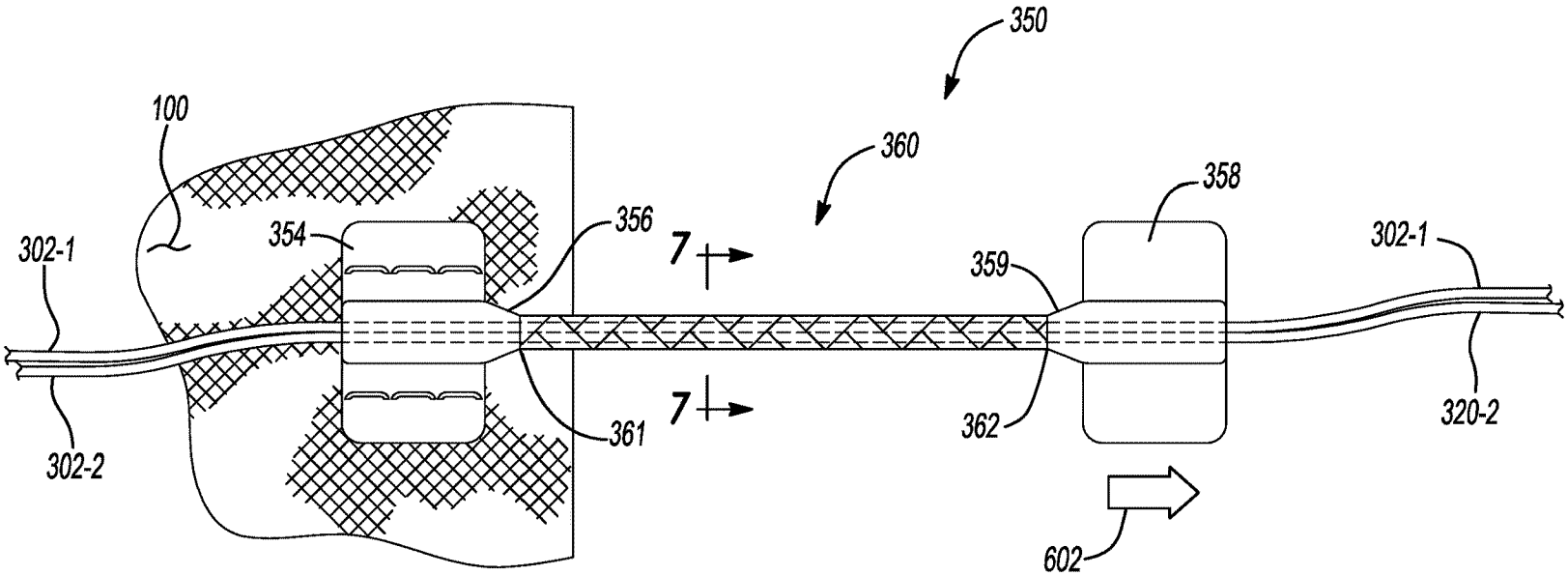
FIG. 6 is a schematic view of the locking device of FIG. 1 showing a braided member biased into an elongated position.
Figure 7:
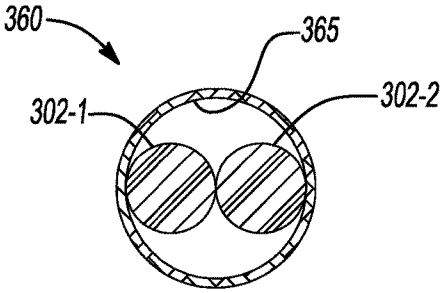
FIG. 7 is a cross-sectional view taken along line 7-7 of FIG. 6 showing an interior wall of the braided member constricted against lace segments of the tensioning cable enclosed therein.

FIG. 6 provides a schematic view of the locking device 350 of FIGS. 1-5 with the release mechanism 352, fabric sleeve 370, and biasing member 372 removed to show the relative positions of the braided member 360 and the first and second attachment mechanisms 354, 358 when the locking device 350 is in the locked state. A biasing force 602 biases the second attachment mechanism 358 away from the first attachment mechanism 354 such that the braided member 360 is retained in the elongated position. The braided member 360 may be formed from multiple strands of monofilament polymer woven together in an interlocking pattern between the first and second ends 361 and 362 of the braided member 360. The elongated position of the braided member 360 constricts the diameter of the interior wall 365 (FIG. 7) to grip and pinch the lace segments 302-1, 302-2 residing therein. FIG. 7 provides a cross-sectional view taken across line 7-7 of FIG. 6 showing the interior wall 365 of the braided member 360 constricted to apply a retention force against the lace segments 302-1, 302-2 when the braided member 360 is in the elongated state. Here, friction between the interior wall 365 and the lace segments 302-1, 302-2 prevents the lace segments 302-1, 302-2 from moving through the braided member 360 in either one of the tightening direction 304 and the loosening direction 306.

Figure 9:
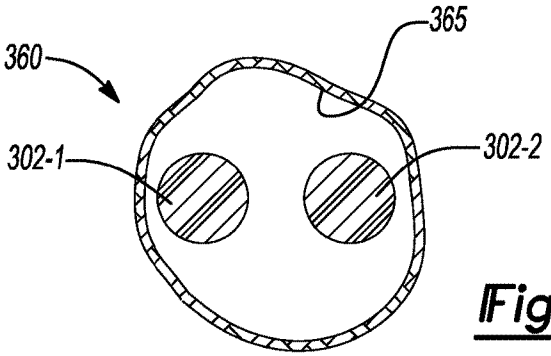
FIG. 9 is a cross-sectional view taken along line 9-9 of FIG. 8 showing an interior wall of the braided member enclosing lace segments of the tensioning cable.
Figure 8:
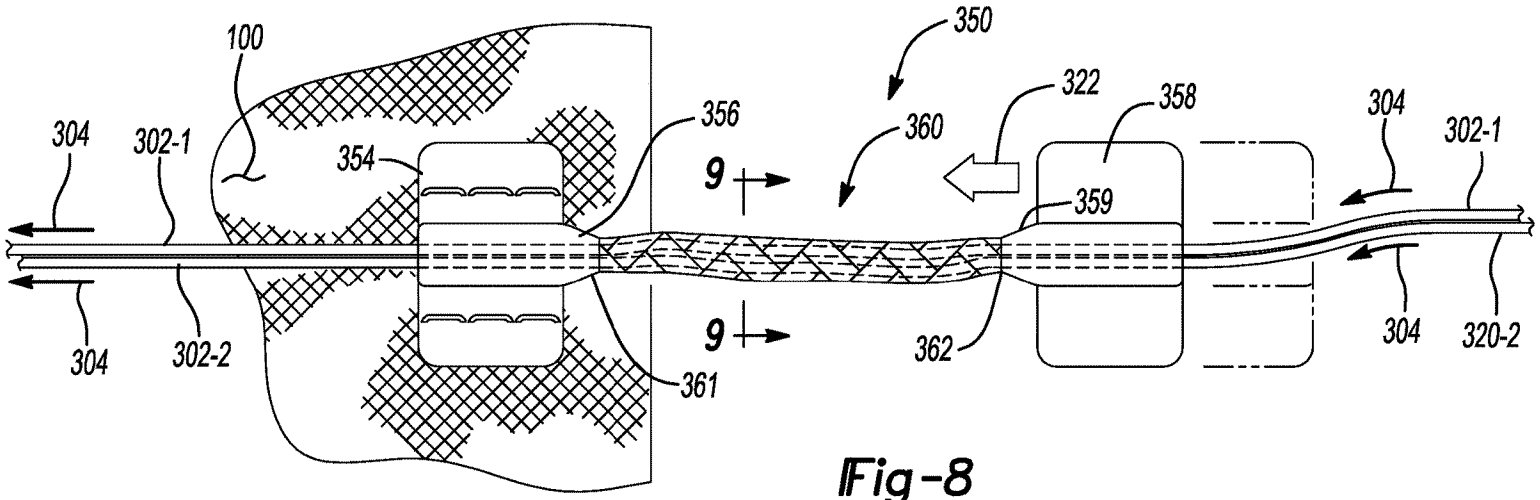
FIG. 8 is a schematic view of the locking device of FIG. 6 showing the braided member moving from the elongated position to an intermediate compressed position to permit movement of the tensioning cable through the braided member in a tightening direction.

FIG. 8 provides a schematic view of the locking device 350 of FIG. 6 showing the braided member 360 moved to the intermediate compressed position when the pulling force 322 (FIG. 3) is applied to the exposed portion of the sheath 306 that extends around the tongue portion 110 of the footwear 10. Here, the pulling force 322 overcomes the biasing force 602 to allow the second attachment mechanism 358 to move relative to the upper 100 in a direction toward the first attachment mechanism 354. The relative movement of the second attachment mechanism 358 causes the distance between the first and second ends 361, 362 of the braided member 360 to decrease such that the braided member 360 moves into the intermediate compressed position. Here, the diameter of the interior wall 365 of the braided member 360 enlarges and the retention force applied against the lace segments 302-1, 302-2 relaxes to permit the movement through the braided member 360 in the tightening direction 304. FIG. 9 provides a cross-sectional view taken across line 9-9 of FIG. 8 showing the interior wall 365 of the braided member 360 enlarging to relax the retention force applied against the lace segments 302-1, 302-2 when the braided member 360 is in the intermediate compressed position. For instance, the interior wall 365 of FIG. 9 defines a larger diameter when the braided member 360 is in the intermediate compressed position compared to the diameter of the interior wall 365 of FIG. 7 when the braided member 360 is in the elongated position. While FIG. 9 shows gaps between the interior wall 365 and each of the lace segments 302-1, 302-2, other configurations may include the interior wall 365 in contact with the lace segments 302-1, 302-2, but drastically reducing the retention force against the lace segments 302-1, 302-2 to permit slippage of the segments 302-1, 302-2 through the braided member 360 in the tightening direction 304.

Figure 10:
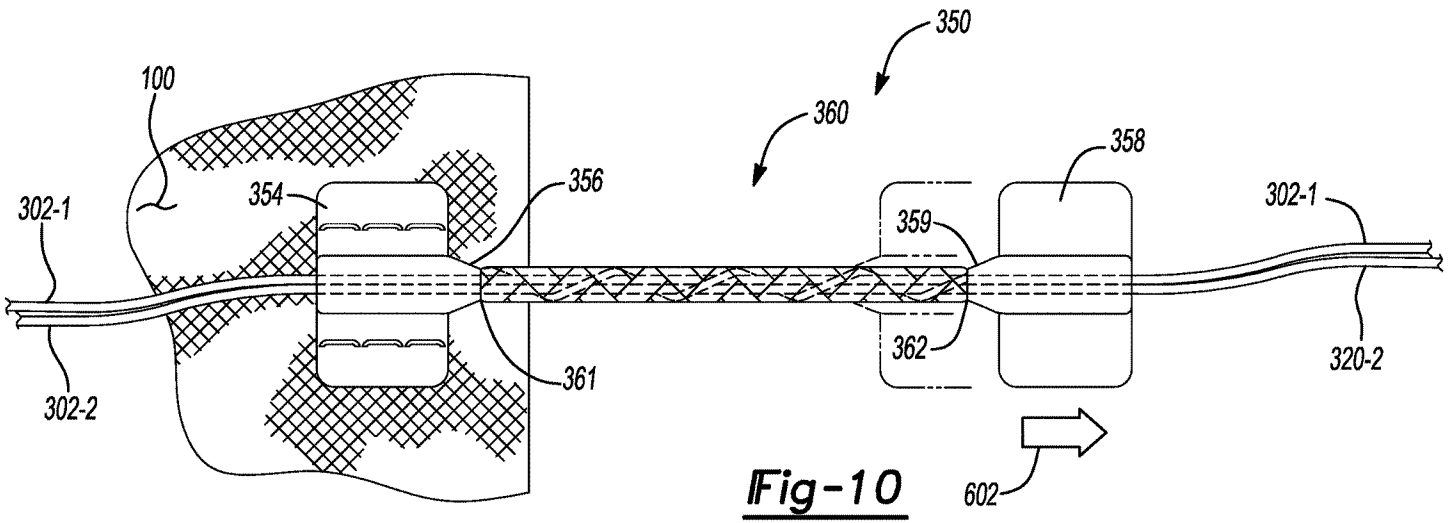
FIG. 10 is a schematic view of the locking device of FIG. 6 showing the braided member reverting back to the elongated position from an intermediate compressed position.

FIG. 10 provides a schematic view of the locking device 350 of FIG. 6 showing the braided member 360 reverting back to the elongated position when the pulling force 322 is released. Here, the biasing force 602 (provided by the biasing member 372) moves the second attachment mechanism 358 away from the first attachment mechanism 354 such that the distance between first and second ends 361, 362 of the braided member 360 increases to move the braided member 360 back to the elongated position. Here, the interior wall 365 of the braided member 360 once again constricts to apply the retention force against the segments 302-1, 302-2 and, thus, prevents the lace segments 302-1, 302-2 from moving through the braided member 360 in either one of the tightening direction 304 and the loosening direction 306.

Figure 11:
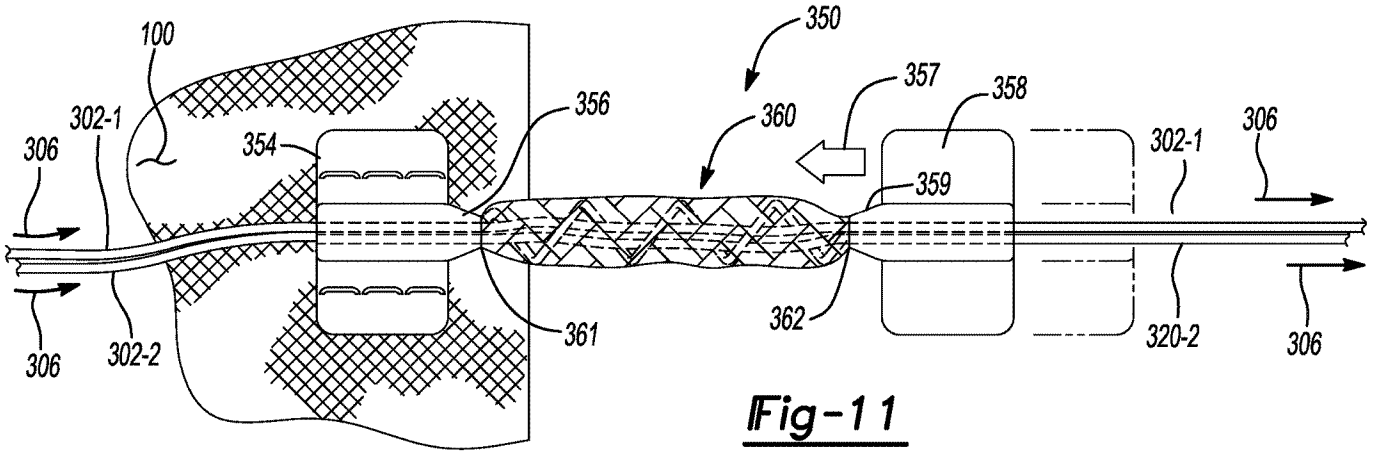
FIG. 11 is a schematic view of the locking device of FIG. 6 showing the braided member moving into a compressed position to permit movement of the tensioning cable therethrough.

FIG. 11 provides a schematic view of the locking device 350 of FIG. 6 showing the braided member 360 moved to the compressed position when the release force 357 (FIG. 5) is applied to the release mechanism 352 (not shown in FIG. 11) operatively connected to the second attachment mechanism 358. Here, the release force 357 overcomes the biasing force 602 to allow the second attachment mechanism 358 to move relative to the upper 100 in a direction toward the first attachment mechanism 354. In some examples, the release force 357 is greater than the pulling force 322 and therefore causes the distance between the first and second ends 361, 362 of the braided member 360 to be shorter when moved into the compressed position of FIG. 11 than when the braided member 360 is moved into the intermediate compressed position of FIG. 8. Thus, the diameter of the interior wall 365 may be greatest when the braided member 360 is in the compressed position to thereby eliminate, or drastically reduce, any retention force applied against the lace segments 302-1, 302-2 that may limit movement of the lace segments 302-1, 302-2 through the braided member 360.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An article of footwear comprising:

an upper;

a tensioning cable operable to move the upper between a tightened state and a loosened state and including a first end disposed on one of a lateral side and a medial side of the upper, the tensioning cable movable in a tightening direction to move the upper into the tightened state and movable in a loosening direction to move the upper into the loosened state; and a locking device disposed on the one of the lateral side and the medial side of the upper, the locking device including a braided conduit receiving a portion of the tensioning cable therein and operable between an elongated position restricting movement of the tensioning cable in both the loosening direction and the tightening direction and a compressed position permitting movement of the tensioning cable in both the loosening direction and the tightening direction.

2. The article of footwear of claim 1, further comprising a sheath extending from a first end disposed on the one of the lateral side and the medial side, around a tongue portion of the upper, and to a second end disposed on the other of the lateral side and the medial side of the upper, the sheath including an inner diameter that is greater than an outer diameter of the tensioning cable and receiving a portion of the tensioning cable therein.

3. The article of footwear of claim 2, wherein the inner diameter is operable to accommodate bunching by the tensioning cable when the tensioning cable is moved in the tightening direction.

4. The article of footwear of claim 1, wherein the tensioning cable extends from the first end, around a tongue portion of the upper, and to a first anchor disposed on the other of the lateral side and the medial side of the upper.

5. The article of footwear of claim 4, wherein the tensioning cable extends from the first anchor around a heel portion of the upper to a second anchor disposed on the one of the lateral side and the medial side of the upper.

6. The article of footwear of claim 5, wherein a location of the second anchor is disposed further from an ankle opening of the upper than the first end of the tensioning cable.

7. The article of footwear of claim 5, further comprising at least one routing conduit including an inner diameter that is greater than an outer diameter of the tensioning cable and receiving a portion of the tensioning cable that extends around the heel portion of the upper between the first anchor and the second anchor.

8. The article of footwear of claim 4, wherein the tensioning cable extends around a heel portion of the upper from the first anchor and through the locking device.

9. The article of footwear of claim 1, wherein the braided conduit is biased in the elongated position by at least one elastic band.

10. The article of footwear of claim 1, wherein the tensioning cable is moved in the tightening direction through the braided conduit when the tensioning cable is pulled away from the upper.

11. The article of footwear of claim 1, wherein the braided conduit is biased in the elongated position and transitions to an intermediate compressed position when the tensioning cable is pulled away from the upper, wherein the intermediate compressed position permits movement of the tensioning cable in the tightening direction and restricts movement of the tensioning cable in the loosening direction.

12. The article of footwear of claim 1, wherein the braided conduit extends between a first end operatively connected to a first attachment mechanism fixedly attached to the one of the lateral side and the medial side of the upper and a second end operatively connected to a second attachment mechanism movable relative to the first attachment mechanism.

13. The article of footwear of claim 12, further comprising a release operatively connected to the second attachment mechanism, the release operable to move the second attachment mechanism toward the first attachment mechanism to move the braided conduit into the compressed position when a force of a predetermined magnitude is applied to the release.

14. The article of footwear of claim 12, wherein the tensioning cable extends from the second attachment mechanism and routes through a series of lateral engagement features extending along a lateral edge of a throat opening of the upper, and a series of medial engagement features extending along a medial edge of the throat opening of the upper.

15. The article of footwear of claim 1, wherein the locking device includes a release lever operable to transition the braided conduit from the elongated position to the compressed position.

16. A method of manufacturing an article of footwear including an upper, the method comprising:

providing a tensioning cable movable in a tightening direction to move the upper into a tightened state and movable in a loosening direction to move the upper into a loosed state, the tensioning cable disposed on one of a lateral side and a medial side of the upper; and extending the tensioning cable through a locking device disposed on the one of the lateral side and the medial side of the upper, the locking device including a braided conduit receiving a portion of the tensioning cable therein and operable between an elongated position restricting movement of the tensioning cable in both the loosening direction and the tightening direction and a compressed position permitting movement of the tensioning cable in both the loosening direction and the tightening direction.

17. The method of claim 16, further comprising extending the tensioning cable through a sheath extending from a first end disposed on the one of the lateral side and the medial side, around a tongue portion of the upper, and to a second end disposed on the other of the lateral side and the medial side of the upper.

18. The method of claim 17, further comprising providing the sheath with an inner diameter that is larger than an outer diameter of the tensioning cable to allow the sheath to accommodate bunching by the tensioning cable when the tensioning cable is moved in the tightening direction.

19. The method of claim 16, further comprising extending the braided conduit between a first end operatively connected to a first attachment mechanism fixedly attached to the one of the lateral side and the medial side of the upper and a second end operatively connected to a second attachment mechanism movable relative to the first attachment mechanism.

* * * * *